US005699736A

United States Patent [19]

Muller et al.

[11] Patent Number: 5,699,736

[45] Date of Patent: Dec. 23, 1997

[54] METHOD AND APPARATUS FOR CONTROLLING THE SHEET SUPPLY IN A SHEET-PROCESSING PRINTING MACHINE

[75] Inventors: Joachim Muller, Pullach; Horst Klingler, Muhlheim, both of Germany

[73] Assignee: MAN Roland Druckmaschinen AG, Germany

[21] Appl. No.: 618,786

[22] Filed: Mar. 20, 1996

[30] Foreign Application Priority Data

Mar. 20, 1995 [DE] Germany ..... 195 10 082.4

[51] Int. Cl.[6] ..... B41F 21/00

[52] U.S. Cl. ..... 101/232; 101/484; 101/148

[58] Field of Search ..... 101/232, 148, 101/144, 145, 351, 352, 233, 234, 350, 484, 485, 349

[56] References Cited

U.S. PATENT DOCUMENTS

| | | | |
|---|---|---|---|
| 3,460,473 | 8/1969 | Norton . | |
| 3,467,007 | 9/1969 | Stotzer et al. . | |
| 3,683,803 | 8/1972 | Gray et al. | 101/132 |
| 5,010,820 | 4/1991 | Loffler . | |
| 5,081,926 | 1/1992 | Rodi . | |
| 5,186,105 | 2/1993 | Emrich et al. | 101/232 |
| 5,533,448 | 7/1996 | Klingler | 101/233 |

FOREIGN PATENT DOCUMENTS

| | | |
|---|---|---|
| 1 611 226 | 12/1970 | Germany . |
| 37 07 695 C2 | 1/1991 | Germany . |
| 40 11 039 A1 | 10/1991 | Germany . |
| 40 13 740 C2 | 6/1993 | Germany . |
| 43 33 071 C1 | 2/1996 | Germany . |

*Primary Examiner*—J. Reed Fisher
*Attorney, Agent, or Firm*—Leydig, Voit & Mayer, Ltd.

[57] ABSTRACT

A method and an apparatus for controlling the sheet supply in a sheet-processing printing machine, in particular a sheet-fed offset printing machine. In order that, at the beginning of printing, before which a specific process for predamping and/or preinking the plate and/or blanket cylinders takes place, a first sheet always runs into the printing zone precisely on completion of the process, provision is made for a first sheet to be conveyed by means of the engagement and renewed disengagement of the feeder into a predetermined position from which the number of machine revolutions up to reaching the first printing zone is known. The feeder is disconnected and the separator and pull suckers remain pressurized, thereby continuing to hold a sheet gripped. The process for predamping and/or preinking is then started, whereupon the reengagement of the feeder takes place precisely at that moment after which a first sheet then runs into the first printing zone precisely on completion of the process sequence.

10 Claims, 6 Drawing Sheets

METHOD AND APPARATUS FOR CONTROLLING THE SHEET SUPPLY IN A SHEET-PROCESSING PRINTING MACHINE

BACKGROUND OF THE INVENTION

1. Field of the Invention

The present invention relates to a method and apparatus for controlling the sheet supply in a sheet-processing printing machine, and more particularly, to a method and apparatus for controlling the sheet supply in a sheet-processing printing machine wherein the sheet supply is synchronized with the predamping and preinking functions such that optimal printing is achieved after a sheet supply interruption.

2. Discussion of the Related Art

In sheet-fed offset printing machines of the type currently widely available, the sheets are taken from the top of a feed pile by a separator and pull suckers pressurized by means of suction air, and are then transported in shingled or imbricated formation to a lay or stop via a conveyor table having suction belts. At the lay or stop, the sheets are aligned in the lateral and circumferential direction. After the correct lay position has been established, the sheet at the lay is picked up by a pregripper and conveyed into the printing unit of the printing machine. The separator, the pull suckers, and the belts of the conveyor table, which are utilized to transport the sheets from the feed pile to the printing unit in a shingled or imbricated formation, are each driven by a drive of the printing machine. The drive of the printing machine is connected to the feed devices via a switchable clutch. Accordingly, the feed devices may be stopped independently of the printing machine. The pressurization of the separator and pull suckers with suction air is likewise independently controllable. Therefore, sheets separated from the pile can still run into the machine via the conveyor table while the sheet removal from the pile has already been stopped.

In order that, at the beginning of printing, an optimum inking state can be achieved after a few sheets have been conveyed through the machine, it is known to predamp and preink the plate and blanket cylinders in the individual printing units for a given number of revolutions. A method for the defined production of an ink distribution close to the production run in the inking unit of rotary printing machines is known, for example, from DE 3 707 695 C2, by means of which method, in the case of an order change, the previous ink profile in the inking unit is broken down and the new ink profile in the inking unit is then built up again.

A method and an apparatus for rapidly reaching the production-run state in an offset printing machine is known from DE 4 013 740 C2, in which, prior to setting the printing operation, provision is made for predamping and preinking of the plate cylinder and of the blanket cylinder.

It is also known in sheet-fed offset printing machines to provide photoelectric scanning control means in the region of the lay, by means of which the lay is blocked if the sheet is not in the correct position. The purpose of blocking the misaligned sheet or double sheet is to prevent the incorrectly aligned sheet or the double sheet from running into the printing machine. If a misfed or double sheet is detected, the clutch is disengaged simultaneously with the termination of the separator and pull suckers, thereby providing for the immediate stoppage of the feeder. After the last sheet to run correctly into the machine has been printed, the consequential impression throw-off then takes place, whereupon the printing machine continues running at the idling speed. In order to be able to resume the printing operation after such a stoppage, the printer has to remove from the conveyor table all the sheets, not only the misaligned or double sheet which is the cause of the stoppage at the lay owing to the stopping of the feeder and the disengagement of the separator and pull suckers. Especially in the case of very sensitive printing materials, these can be damaged when being removed and are thus no longer usable. Since there are in the order of magnitude of four to seven sheets located between the feed pile and the lay, depending on the length of the conveyor table and the degree of shingling or imbrication, stoppages, in particular frequent stoppages, constitute a cost-intensive loss of printing materials.

Moreover, it is to be considered disadvantageous that, especially for the first two printing units of a sheet-fed offset printing machine, after engagement of the feeder, insufficient revolutions are available for predamping and preinking of the plate and blanket cylinders to be carried out for a given number of machine revolutions. In this case too, the first sheets running into the machine after it has been started up again do not receive the optimum inking, which means that additional waste occurs.

A method and an apparatus for controlling the sheet run-in during the start-up of a sheet-processing printing machine is known from DE 43 33 071 C1. The feeder is engaged and disengaged in such a way that the sheet run-in takes place synchronously with the vibrator roller, that is to say always in the same position of the vibrator roller.

DE-OS 1 611 226 discloses a control for a rotary printing machine, in which especially for facilitating the introduction of an auxiliary palette in the delivery unit stack the sheet flow from the feed (Anleger) is interrupted for a certain number of machine revolutions. This occurs by corresponding switching-off of the members bringing about the sheet take-off. With the generating of an interruption in the sheet flow there can likewise be provided a corresponding switching in proper sequence of the moistening mechanisms as well as of the inking mechanisms in the individual printing mechanisms. The switching in correct order, especially of the printing mechanism cylinders in correspondence to the sheet running is disclosed in U.S. Pat. No. 3,467,007.

DE 4 011 039 A1discloses a control circuit for a printing mechanism of an offset sheet printing machine, in which in correspondence to the sheet running there occurs the switching of the moistening and/or ink-applying rollers. With this control circuit there is to be achieved, in particular a reduction of waste paper in the starting of the printing machine. This control circuit relates there to a special moistening/inking mechanism type with bridge roller or intermediate roller switchable

SUMMARY OF THE INVENTION

In accordance with a first aspect, the present invention is directed to a method for controlling the sheet supply in a sheet-fed offset printing machine. The method comprises moving sheets from a feed pile to a conveyor table, feeding the sheets to the printing machine, stopping the feeding of the sheets to the printing machine when the first sheet of the sheets reaches a set position on the conveyor table, implementing a predamping and preinking process in a first printing unit of the printing machine, and restarting the feeding of sheets to the printing machine after a number of printing machine revolutions in the predamping and preinking process such that the first sheet at the set position reaches a first printing zone in the first printing unit with the expiration of the predamping and preinking process.

In accordance with a second aspect, the present invention is directed to a sheet feed apparatus for controlling the sheet supply in a sheet-fed offset printing machine. The sheet feed apparatus for controlling the sheet supply in a sheet-fed offset printing machine comprises a sheet removal means for removing sheets from a feeder unit pile, a transport means for transporting the sheets to at least one printing unit of the printing machine, a lay and pregripper for inputting the sheets from the transport means into the at least one printing unit, a sensor means for determining the presence of a misaligned sheet or double sheets at the lay and pregripper, and a controller coupled to the sheet removal means, the transport means, the lay and pregripper, and the sensor means. The controller, upon printing machine start-up, stops the operation of the transport means and the sheet removal means when a first sheet reaches a set position on the transport means and implements a predamping and preinking process in the at least one printing unit and thereafter starts the operation of the sheet removal means and the transport means such that upon completion of the predamping and preinking process a sheet is available for printing. The controller, upon the detection of a misaligned or double sheets, stops the operation of the transport means and the sheet removal means until the misaligned sheet or double sheets and at least one sheet adjacent thereto are removed and a predamping and preinking process is completed, and thereafter starts the operation of the transport means and the sheet removal means such that upon completion of the predamping and preinking process a sheet is available for printing.

According to the present invention, provision is made for the feeder to be engaged prior to starting a process for predamping and preinking and thus for sheets to be conveyed in a shingled formation up to a given position on the conveyor table, the given position being characterized in that, from this position, the number of machine revolutions up to printing of the first sheet is known. When the first sheet has reached the position characterized in this manner, the feeder is disengaged, and the pressurization of the separator and pull suckers with suction air is maintained, thereby holding the last sheet removed from the feed pile in place.

When the feeder has been disengaged, the process for predamping and preinking the plate cylinder and/or blanket cylinder in the first printing unit is then started. In corresponding sequence, the predamping and preinking process in the other printing units are additionally started, but offset in time. In this case, the mechanical engagement of the feeder takes place precisely when the intended number of machine revolutions for the process of predamping and preinking, reduced by the number which a first sheet requires from the stationary position of the feeder up to the first printing unit, has been completed. It is thus achieved that the paper run-in into the printing machine always takes place synchronized with the process sequence of predamping and preinking.

The present invention may comprise a preinterrogator, for example, a photoelectric device, arranged on the conveyor table ahead of the lay in the sheet-running direction. The preinterrogator is preferably mounted in the conveyor table in such a way that the third sheet located in the shingle arrangement has not yet reached the preinterrogator when, owing to the first sheet in the shingle at the lay (cause of the stoppage) the lay is blocked and the feeder is thus stopped. The printer then only needs to remove the incorrect sheet and the two following sheets from the conveyor table, in this case it is assumed that, owing to the stoppage, these sheets will also no longer assume a correct shingle position, whereupon the sheet, which is now located at the front in the shingle, is conveyed by renewed engagement of the feeder to a position where the preinterrogator detects its arrival.

In this embodiment of the invention, the preinterrogator has a dual function, namely on the one hand it can be established by the preinterrogator whether, after a stoppage, the printer has removed the cause of the stoppage and the appropriate number of following sheets from the conveyor table. On the other hand, it can be established by this preinterrogator when the sheet, which is then located at the front in the shingle, reaches the preinterrogator, that is to say when the feeder is to be stopped again. By means of the stopping of the feeder then triggered, the position of the preinterrogator thus defines the predetermined position from which the sheet run is started again when the intended process for predamping and preinking of the plate and/or blanket cylinders has been started.

BRIEF DESCRIPTION OF THE DRAWINGS

Exemplary embodiments of a method and apparatus for controlling the sheet supply in a sheet-processing printing machine in accordance with the present invention is described below with reference to the accompanying drawings in which.

DETAILED DESCRIPTION OF THE PREFERRED EMBODIMENTS

The method and apparatus for controlling the sheet supply in a sheet processing printing machine according to the present invention ensures that proper predamping and preinking of the blanket and plate cylinders of the printing units of the printing machine occurs during normal operation start-up and after an interruption of the printing cycle. An interruption of the printing cycle may occur for a number of reasons including the detection of a misfed sheet, a misaligned sheet or double sheets. Accordingly, since proper predamping and preinking is ensured, waste is reduced by the elimination of poor quality prints.

Figure 1:
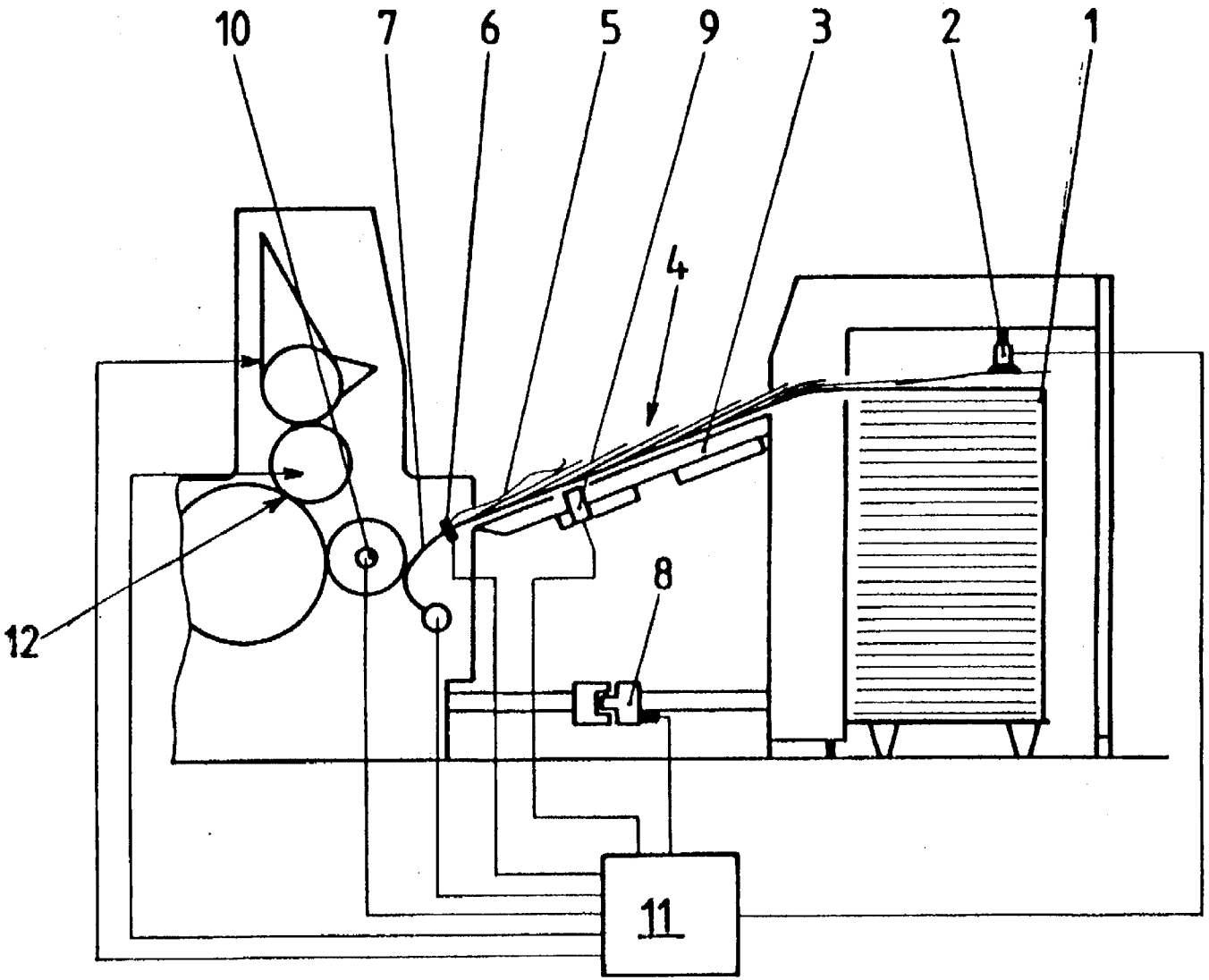
FIGS. 1 and 2 are diagrammatic representations of an exemplary sheet feed pile of a sheet feed unit and a first printing unit of a sheet-fed offset printing machine in accordance with the present invention.
Figure 2:
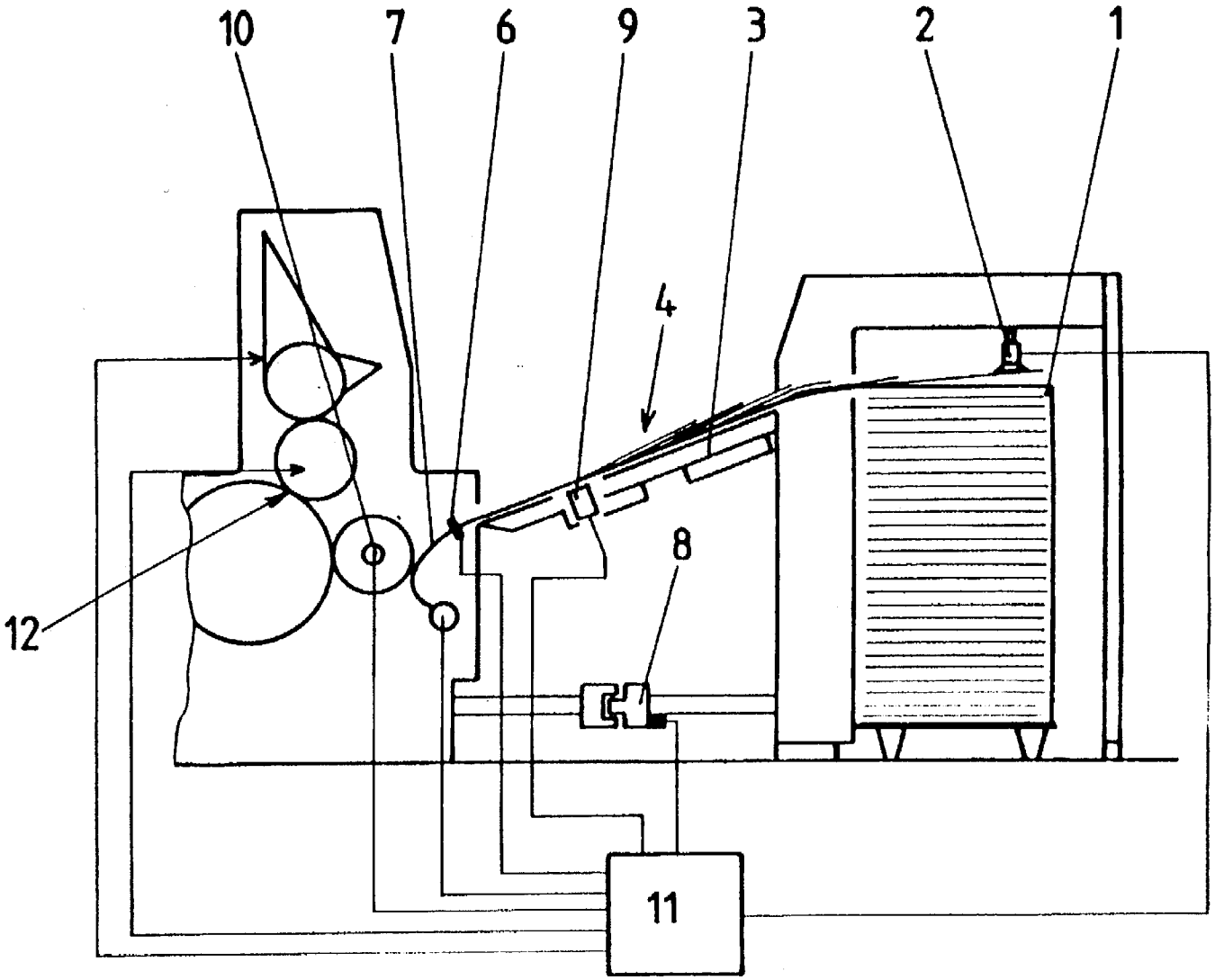

FIGS. 1 and 2 illustrate an exemplary embodiment of a sheet feed pile 1 of a sheet feed unit and a first printing unit of a sheet-fed offset printing machine. In operation, individual sheets 4 are removed from the top of the sheet feed pile 1 by a separator and pull suckers 2 and are transported in a shingled or imbricated formation onto a top side of a conveyor table 3. The sheets 4 on the top side of the conveyor table 3 are then conveyed by conveyor belts (not illustrated) in an imbricated fashion to a lay or stop 6 where, after an alignment process and once correct positioning of the sheets 4 has been verified, the individual sheets 4 at the lay 6 are seized by a pregripper 7 and accelerated to the circumferential speed of the various cylinders comprising the printing unit. This operation is controlled by a controller 11 as explained in detail subsequently.

A detailed description of an exemplary transport arrangement for transporting sheets from a feeder unit to a printing unit is disclosed in U.S. Pat. No. 4,420,747, assigned to the same assignee as the present invention, and incorporated by reference herein. The sheets 4 may be aligned utilizing any suitable process and device. For example, the sheets 4 may be aligned in accordance with the method disclosed in U.S. Pat. No. 5,186,105, assigned to the same assignee as the present invention and incorporated by reference herein. Verification of the correct positioning of the sheets 4 may be made by any suitable means, such as sheet sensors, for example, optoelectronic sensors such as disclosed in U.S. Pat. No. 5,186,105.

A specific number of sheets 4 are resting on the conveyor table 3 at any given time during normal operation. The number of sheets 4 on the conveyor table 3 may be determined based on the format length of the sheets 4, the degree of imbrication, and the distance between the lay 6 and the sheet feed pile 1. Typically, four to seven sheets 4 may be on the conveyor table 3 during normal operation.

In order to illustrate the method for controlling sheet feed according to the present invention, it is assumed that a misfed sheet, a misaligned sheet, or double sheets 5 is/are at the lay 6, as is illustrated in FIG. 1. Accordingly, once the misfed sheet, the misaligned sheet, or double sheets 5 is/are detected by the sheet sensors (not illustrated), the lay 6 is blocked and the operation of the pregripper 7 terminated to prevent the misfed sheet, the misaligned sheet, or double sheets 5 from entering the printing unit. Simultaneously, a clutch 8 of the drive mechanism of the printing machine is disengaged and the movement of the separator and pull suckers 2 is stopped, thereby preventing the continued feed of new sheets 4 from the top of the sheet feed pile 1. The separator and pull suckers 2, however, remain pressurized so that the last sheet 4 picked-up by the separator and pull suckers 2 remains in its current position during the disengagement of the drive mechanism.

Once the sheet feeder pile 1 has been disengaged from the printing machine drive by means of the clutch 8 and the separator and pull suckers 2 are holding the last sheet 4 removed from the sheet feeder pile 1 in a fixed position, a printer or system operator removes the misfed sheet, the misaligned sheet or double sheets 5. In addition, the printer also removes additional sheets 4 behind the misfed sheet, the misaligned sheet, or double sheets 5. The number of additional sheets 4 removed is determined by the positioning of a preinterrogator 9. Essentially, all sheets 4 on the conveyor table 3 between the lay 6 and the preinterrogator 9 are removed. It is important to note that the sheets already in the printing unit are printed.

The preinterrogator 9 is mounted in the conveyor table 3 at a position between the lay 6 and the sheet feed pile i such that the majority of sheets 4 are between a position behind the preinterrogator 9 and the sheet feed pile 1. By positioning the preinterrogator 9 in this manner, waste may be reduced. In the exemplary embodiments illustrated in Figures 1 and 2, when the misfed sheet, the misaligned sheet, or double sheets 5 is are at the lay 6, a leading edge of the fourth sheet 4, as counted from the lay 6, in the imbricated arrangement of sheets 4 has not yet reached the position of the preinterrogator 9. The preinterrogator 9 may comprise any suitable device for detecting the presence of a sheet 4. In an exemplary embodiment, the preinterrogator 9 comprises a photoelectric device for determining the presence of a sheet 4.

Once the sheets between the lay 6 and the preinterrogator 9 are removed by the printer as determined by the preinterrogator 9, the sheet feed pile 1 is re-engaged to the drive mechanism via the clutch 8 in order to convey the sheets 4 between the preinterrogator 9 and the sheet feed pile 1 up to the preinterrogator 9 and to place additional sheets 4 from the sheet feed pile i onto the conveyor table 3 via the separator and pull suckers 2. Accordingly, a full conveyor table 3 may be established. When the lead sheet 4 reaches the preinterrogator 9, the drive mechanism is once again disengaged via the clutch 8 and the movement of the separator and pull suckers 2 is halted. However, as before, the separator and pull suckers 2 remain pressurized. FIG. 2 illustrates the lead sheet 4 in position at the preinterrogator 9.

As discussed above, a controller 11 controls the operation of the sheet feed process of the present invention. The controller 11 is utilized to engage and disengage the clutch 8 of the drive mechanism, to control the operation of the separator and pull suckers 2, and to control the operation of the lay 6 and the pregripper 7 in accordance with a predetermined control program and based upon feedback signals from the preinterrogator 9 and the sheet sensors (not illustrated). In addition, the controller 11 is also connected to and receives feedback signals from an angle indicator 10 mounted on or in a single turn shaft of the printing machine. The angle indicator 10 is utilized to determine the number of revolutions of the rollers in the printing machine for implementing the predamping and preinking functions, as is explained in detail subsequently.

In operation, once the sheet sensors determine the presence of a misfed sheet, a misaligned sheet, or double sheets 5 at the lay 6, a signal from the sheet sensors is transmitted to the controller 11 which in response thereto sends a signal to the clutch 8, thereby disengaging the clutch 8 and terminating the operation of the sheet feed pile 1. Simultaneously, the controller 11 outputs signals to the lay 6 and the pregripper 7 to terminate their operation also. Once the misfed sheet, the misaligned sheet, or double sheets 5, and the remaining sheets 4 between the lay 6 and the preinterrogator 9 is are removed by the printer or system operator, the controller 11 receives a signal from the preinterrogator 9 indicating this fact and outputs a command engaging the clutch 8 thereby causing a conveyance of sheets 4 up to the preinterrogator 9, whereupon, the operation once again ceases as described above. Thereafter, the predetermined control program sequence for predamping and preinking is initiated as is explained in detail subsequently.

Figure 6:
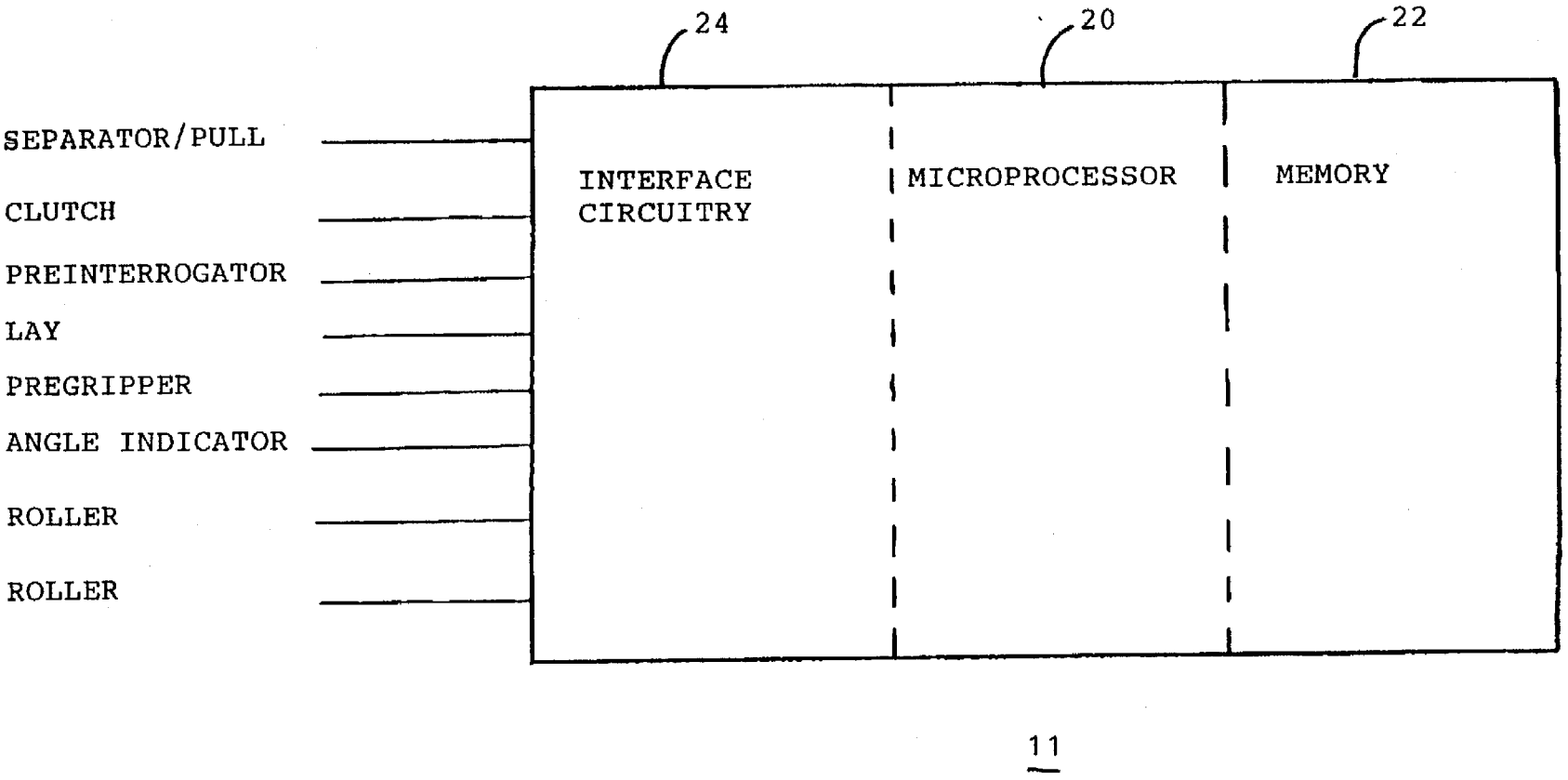
FIG. 6 is a block diagram of a controller for a sheet-fed offset printing machine.

The controller 11 may comprise a hardware controller, a software controller, or a combination hardware/software controller. In the preferred embodiment, the controller 11 comprises a hardware/software controller. FIG. 6 is a block diagram representation of an exemplary controller 11. The exemplary controller 11 comprises a microprocessor 20, memory 22, and interface circuitry 24. The memory 22 comprises the predetermined control program software to implement the above-described sheet feed process as well as the preinking and predamping. The interface circuitry 24 includes all the circuits for the communication of information and commands between the controller 11 and the devices to which the controller 11 is connected. For example, the interface circuitry 24 comprises analog-to-digital converters for converting the analog signals from the sheet sensors and the angle indicator 10 into digital format signals for the microprocessor 20. The interface circuitry also comprises digital-to-analog converters for converting the commands output from the microprocessor 20 into analog format signals which may be implemented by the various devices connected to the controller 11, for example, the pregripper 7. The controller 11 may be connected to the various devices through the interface circuitry 24 via any suitable means such as switching devices, for example, relays or solenoid switches.

Once the sheets 4 are in the position illustrated in FIG. 2, e.g., the lead sheet 4 is at the preinterrogator 9, the process of predamping and preinking of the plate and blanket cylinder in the first printing unit is initiated. In a typical offset printing machine, a printing plate is mounted on a plate cylinder. Ink is applied to the printing plate via an inking unit. The printing plate, however, does not directly contact the sheets fed through the printing machine, rather, the ink from the printing plate is transferred to a rubber blanket mounted on a blanket cylinder. In order to aid in the transfer of ink from the printing plate to the rubber blanket, the printing plate is dampened by a damping fluid from a damping unit. To produce a print on the sheets, the sheets are conveyed over a back pressure cylinder which cooperates with the blanket cylinder. A detailed description of an exemplary printing machine is given in U.S. Pat. No. 4,581,993. The preinking and predamping process in accordance with the present invention is also controlled by the controller 11.

In order to ensure that sufficient revolutions of the rollers in the printing unit are implemented for proper predamping and preinking after a stoppage due to a misfed sheet, a misaligned sheet, or double sheets, the controller 11 implements a predamping and preinking process. Essentially, when the sheet feed pile 1 is disengaged from the drive mechanism via the clutch 8, the predamping and preinking process in the first printing unit is initiated by the controller 11. In a corresponding sequence thereafter, the predamping and preinking process in the remaining printing units is initiated at corresponding offset time intervals. The reengagement of the sheet feed pile 1 to the drive mechanism takes place precisely when the intended number of machine revolutions for predamping and preinking, reduced by the number which a first sheet requires from the stationary position of the feed pile 1 up to the first printing unit, has been completed. Accordingly, the sheet run-in into the printing unit occurs in synchronization with the predamping and preinking.

In an exemplary embodiment, if it is intended that the predamping and preinking process run for a total of n revolutions before a sheet 4 enters the printing zone 12 of the first printing unit and m is the number of revolutions of the single-turn shaft, in which the angle indicator 10 is mounted, that is completed during the transport time of the sheet 4 from a position on the conveyor table 3 corresponding to the preinterrogator 9 to the printing zone 12 in the first printing unit, then after n-m revolutions, the controller 11 reinitiates the sheet feed by engaging the drive mechanism via the clutch 8 and activating the lay 6 and the pregripper 7. It is important to note that the transport time of the particular sheet need not be calculated from a starting position at the preinterrogator 9, but at any point on the conveyor table 3. The number of revolutions m depends on the design of the printing machine and the arrangement of the preinterrogator 9 on the conveyor table 3. In particular, m is not an integer and n is greater than m.

The controller 11 is coupled to the angle indicator 10 and is operable to receive signals indicative of the number of rotations of the single-turn shaft in which it is mounted. The controller 11, in accordance with the predetermined process program, calculates n−m as indicated above and outputs signals to the clutch 8, lay 6, pregripper 7 and the separator and pull suckers 2 to reinitiate the sheet feed. An exemplary angle indicator 10 is disclosed in U.S. Pat. No. 4,581,993, assigned to the same assignee as the present invention and incorporated by reference herein.

Figure 3:
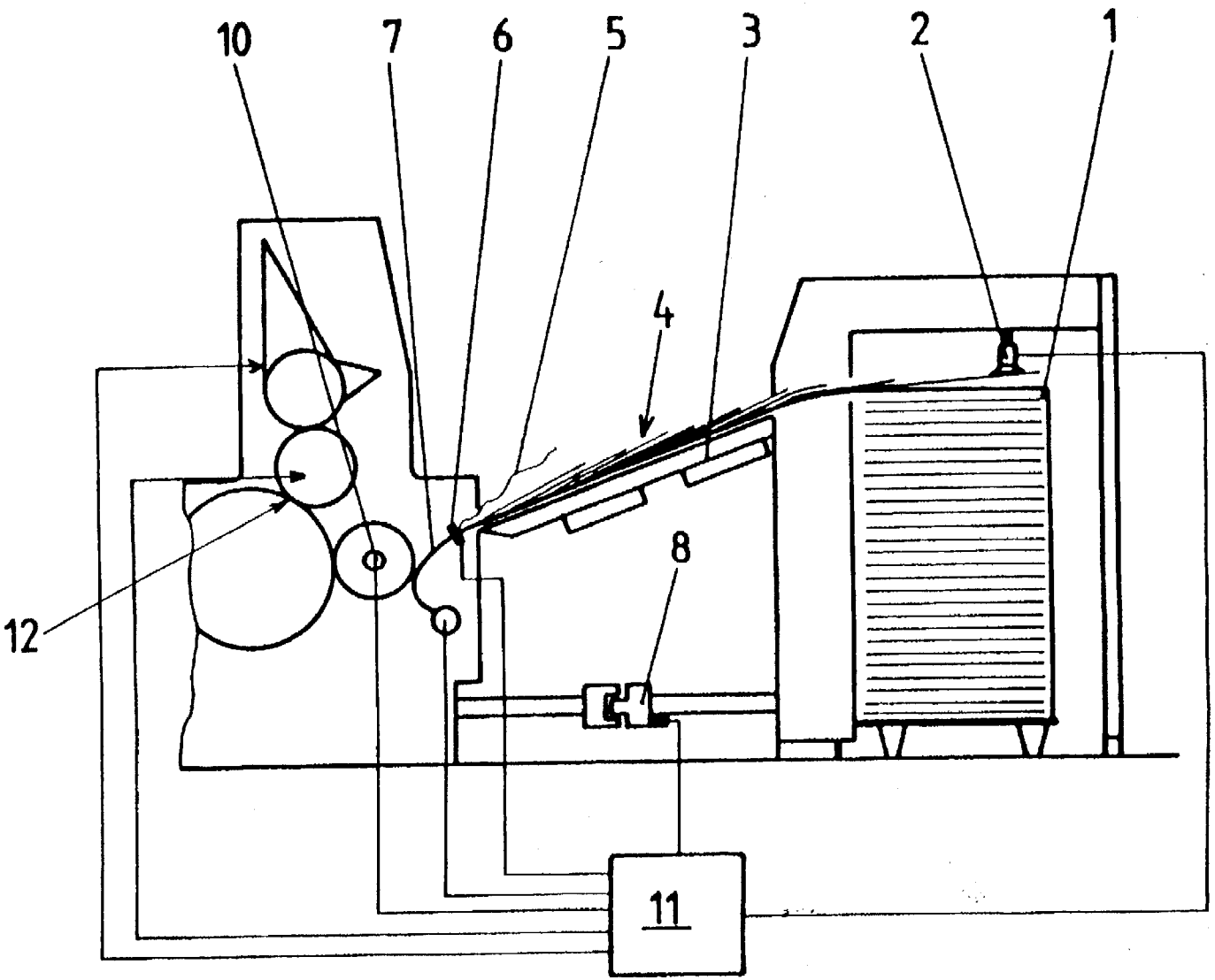
FIGS. 3, 4 and 5 are diagrammatic representations of an alternate embodiment of a sheet feed pile of a sheet feed unit and a first printing unit of a sheet-fed offset printing machine in accordance with the present invention.
Figure 4:
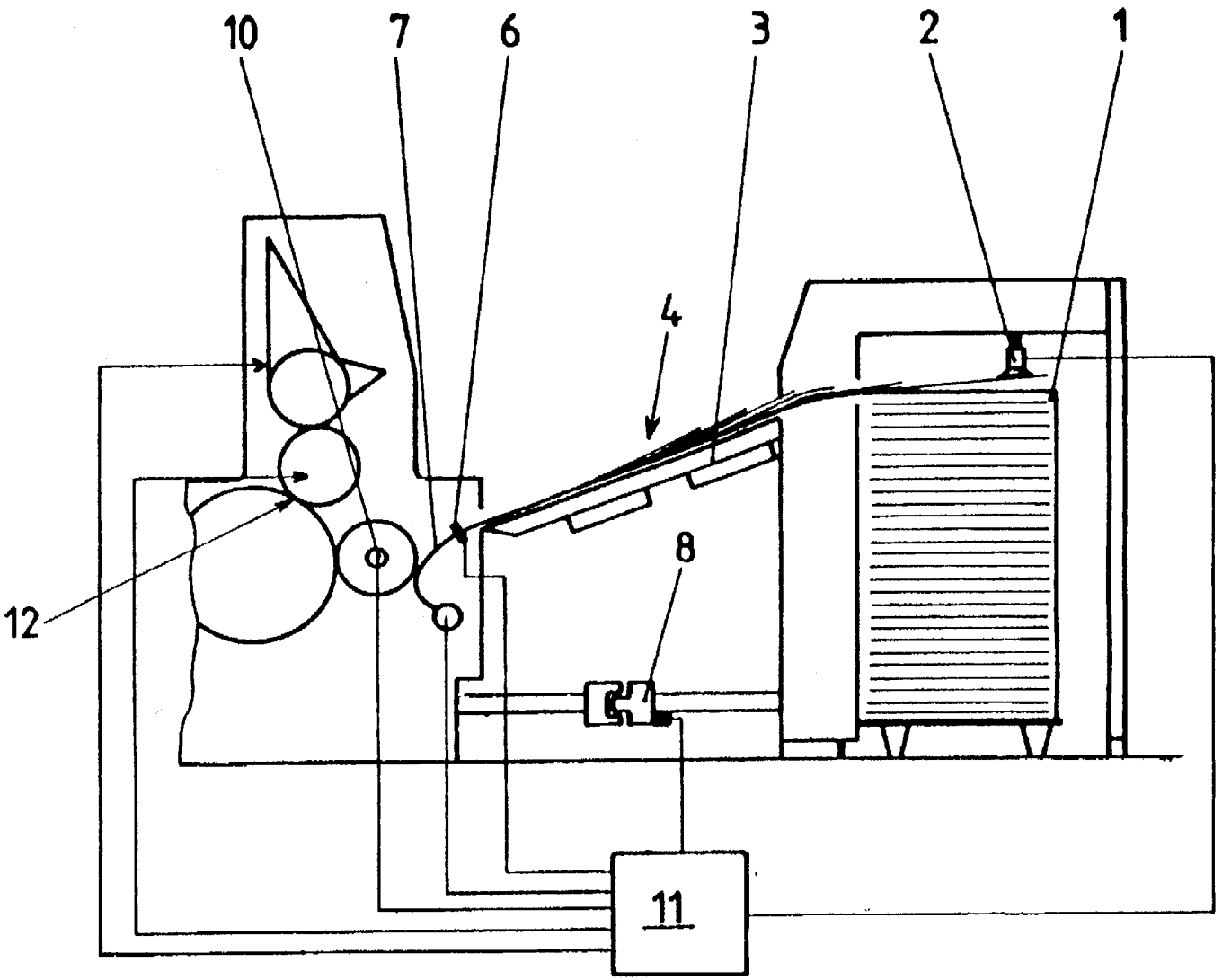
Figure 5:
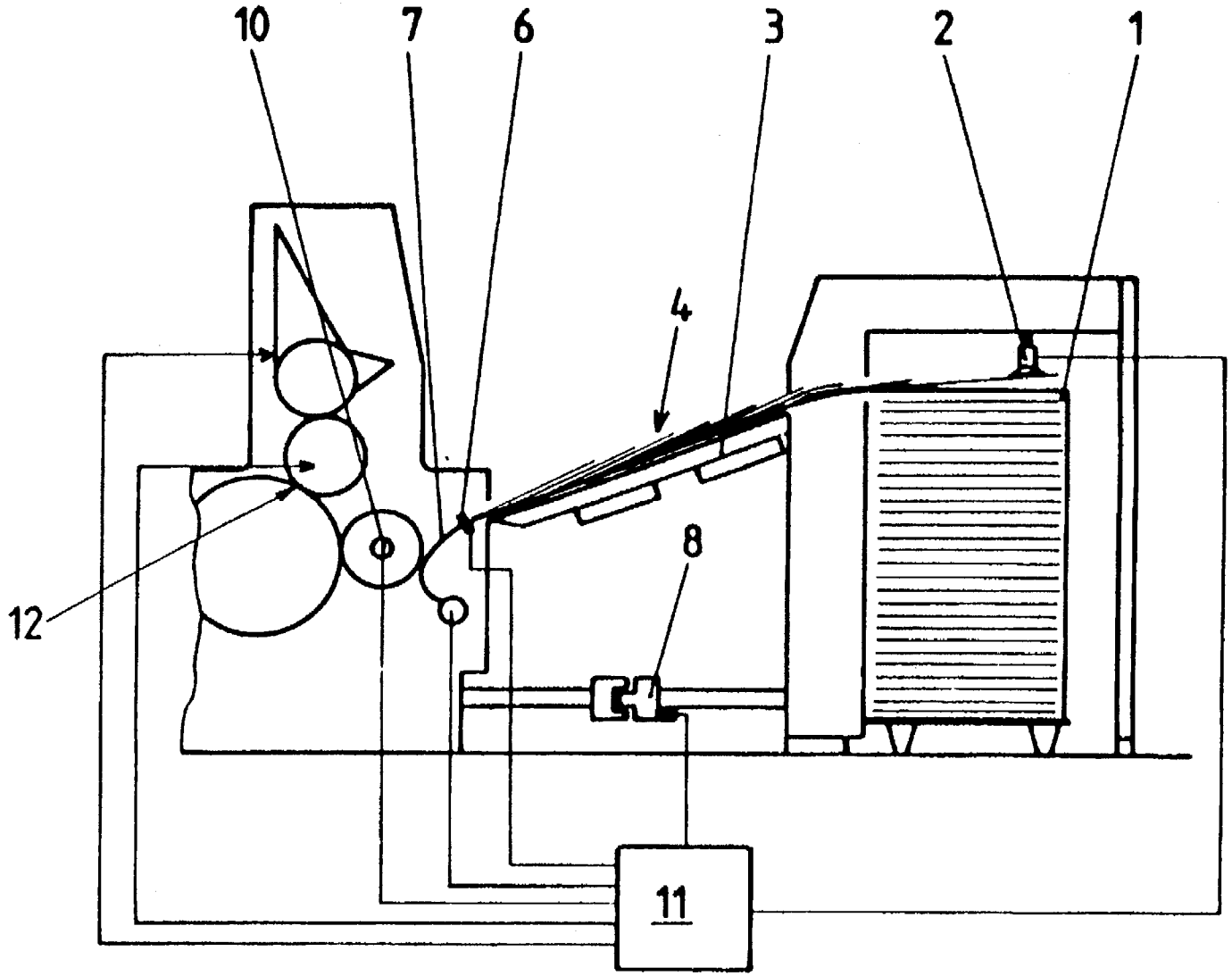

FIGS. 3, 4, and 5 illustrate an exemplary alternative embodiment of a sheet feed pile 1 of a sheet feed unit and a first printing unit of a sheet-fed offset printing machine. In this embodiment, there is no preinterrogator mounted in the conveyor table 3, but the process is similar to that described above with reference to FIG. 1 and 2. When a misfed sheet, a misaligned sheet, or double sheets 5 has/have reached the lay 6, the sheet sensors or lay control (not illustrated) detect this problem and disengage the sheet feed pile 1 via the clutch 8. As before, the separator and pull suckers 2 continue to hold the top sheet in the feed pile i in position. All sheets fed into the printing unit prior to the interruption continue through the printing unit and are printed out, whereupon the consequential impression throw-off takes place after a final sheet in the unit has been printed.

After the printer or system operator has removed the cause of the interruption, e.g., the misfed sheet, the misaligned sheet, or double sheets 5 and possibly one or more remaining sheets 4, adjacent the bad sheet 5 from the conveyor table 3, as illustrated in FIG. 4, the drive mechanism is reengaged until the first remaining sheet 4 on the conveyor table 3 reaches the lay 6. The detection of the sheet 4 is accomplished via the sheet sensors or lay control (not illustrated). As before, the drive mechanism is disengaged and the predamping and preinking process is initiated. In this case too, it can be assumed that n revolutions are provided for this sequence. On completion of n−m revolutions (n>m), the feeder is engaged by means of the clutch 8, whereupon the first sheet lying correctly against the lay 6 is picked up by the pregripper 7. In this case too, m is the number of single-turn machine revolutions which the sheet has to complete from the lay 6 up to the printing zone 12 in the first printing unit. Furthermore, this number of revolutions m depends on the design circumstances of the printing machine, that is to say ultimately on the path, relating to a single-turn shaft, from the lay 6 to the printing zone 12 mentioned.

It is guaranteed by the procedures described above and the appropriate designs in terms of the apparatus that, in an intended program sequence for predamping and preinking, a first sheet to be printed always reaches the respective printing zone 12 synchronously with the end of the program.

Although, shown and described is what is believed to be the most practical and preferred embodiments, it is apparent that departures from specific methods and designs described and shown will suggest themselves to those skilled in the art and may be used without departing from the spirit and scope of the invention. The present invention is not restricted to the particular constructions described and illustrated, but should be construed to cohere with all modifications that may fall within the scope of the appended claims.

We claim:

1. In a sheet-fed offset printing machine having a conveyer table connecting a sheet feeder unit to a first printing unit, a method for controlling the sheet supply in the sheet-fed offset printing machine comprising: moving a plurality of sheets from a feed pile to the conveyor table; feeding the plurality of sheets via the conveyor table to the printing machine; stopping the feeding of the plurality of sheets to the printing machine when a first sheet of the plurality of sheets reaches a set position on the conveyor table; determining a number of printing machine revolutions required for a predamping or a preinking process; determining a number of printing machine revolutions required for the first sheet of the plurality of sheets to reach a first printing zone in the first printing unit from the set position on the conveyor table; determining a delay number of printing machine revolutions to delay the feeding of the plurality of sheets to the printing machine based on (1) the number of printing machine revolutions required for the predamping or the preinking process and (2) the number of printing machine revolutions required for the first sheet of the plurality of sheets to reach the first printing zone in the first printing unit from the set position on the conveyor table, such that the first sheet of the plurality of sheets at the set position reaches the first printing zone in the first printing unit approximately upon the expiration of the predamping or the preinking process; implementing the predamping or the preinking process in the first printing unit of the printing machine; and restarting the feeding of the plurality of sheets to the printing machine after the delay number of printing machine revolutions in the predamping or the preinking process.

2. The method of claim 1, wherein the step of stopping the feeding of the plurality of sheets includes disengaging a feeder unit from a drive mechanism of the printing machine.

3. The method of claim 2, wherein the step of restarting the feeding of the plurality of sheets includes engaging the feeder unit to the drive mechanism of the printing machine.

4. The method of claim 1, wherein the step of stopping the feeding of the plurality of sheets to the printing machine, the set position corresponds to a lay at the end of the conveyor table.

5. The method of claim 1, wherein the step of stopping the feeding of the plurality of sheets to the printing machine, the set position corresponds to a point prior to a lay at the end of the conveyor table.

6. The method of claim 1, further comprising the steps of: interrupting the feeding of sheets upon the detection of at least one of a misfed sheet, a misaligned sheet and double sheets; removing the at least one of the misfed sheet, the misaligned sheet and the double sheets and at least one other sheet adjacent thereto.

7. A sheet feed apparatus for controlling the sheet supply in a sheet-fed offset printing machine comprising: a controller for coordinating the components and operation of the sheet feed apparatus; a sheet removal mechanism, responsive to the controller, for removing a plurality of sheets from a feeder unit pile; a transport mechanism, responsive to the controller, for receiving the plurality of sheets from the sheet removal mechanism and transporting the plurality of sheets to an at least one printing unit of the printing machine; a preinterrogator for detecting the presence of one of the plurality of sheets at a set position and generating a sheet position indicator signal; and a lay and a pregripper, both responsive to the controller, for inputting the sheets from the transport mechanism into the at least one printing unit; a printing roller sensor for indicating the position of a printing roller of the at least one printing unit and generating a roller position signal; wherein, the controller coordinates the operation of sheet removal mechanism and the transport mechanism until receiving the sheet position indicator signal and monitoring the roller position signal to determine the approaching completion of a predamping or preinking process, then coordinates the operation of the lay and the pregripper based on the time required to complete the predamping or preinking process and the time required for a first sheet of the plurality of sheets to reach a first printing zone in a first printing unit such that the completion of the predamping or preinking process is synchronized with the arrival of the first sheet at the first printing zone.

8. The sheet feed apparatus of claim 7, wherein the transport mechanism includes a conveyor table, and the preinterrogator is mounted in the conveyor table at a set distance from the lay.

9. The sheet feed apparatus of claim 7, further comprising: a sheet misfeed sensor, coupled to the controller, for generating a misfeed signal upon detection of a misaligned sheet or a double sheet condition, wherein the controller stops the operation of the sheet removal mechanism and the transport mechanism upon receiving the misfeed signal.

10. The sheet feed apparatus of claim 9, wherein the printing process is restarted after clearing the misaligned sheet or double sheet condition causing the misfeed signal to be generated by the sheet misfeed sensor and at least one additional sheet adjacent such that the first sheet of the plurality of sheets reaches the first printing zone in the first printing unit so that the completion of the predamping or preinking process is synchronized with the arrival of the first sheet at the printing zone.

* * * * *